US005601156A

United States Patent [19]

McCarthy et al.

[11] Patent Number: 5,601,156

[45] Date of Patent: Feb. 11, 1997

[54] MAINTAINING COMMUNICATIONS AND POWER DURING TRANSFER OF HORIZONTALLY MOVEABLE ELEVATOR CAB

[75] Inventors: Richard C. McCarthy, Simsbury; Joseph Bittar, Avon; Frederick H. Barker, Bristol; Bruce A. Powell, Canton; Samuel C. Wan, Simsbury; Paul Bennett, Waterbury; Anthony Cooney, Unionville; John K. Salmon, deceased, late of South Windsor, all of Conn., by LucyMary Salmon, legal representative

[73] Assignee: Otis Elevator Company, Farmington, Conn.

[21] Appl. No.: 630,223

[22] Filed: Apr. 10, 1996

Related U.S. Application Data

[63] Continuation-in-part of Ser. No. 565,647, Nov. 29, 1995, abandoned.

[51] Int. Cl.[6] ..... B66B 9/00

[52] U.S. Cl. ..... 187/249; 187/413; 187/290

[58] Field of Search ..... 187/249, 413, 187/290

[56] References Cited

U.S. PATENT DOCUMENTS

| | | | |
|---|---|---|---|
| 1,027,628 | 5/1912 | Schwab | 187/249 |
| 1,923,603 | 8/1933 | Winslow | 187/249 |
| 1,939,729 | 12/1933 | Stark | 187/249 |
| 2,052,690 | 9/1936 | Austin | 187/249 |
| 3,707,205 | 12/1972 | Gibson | 187/413 |
| 4,529,062 | 7/1985 | Lamprey | 187/413 |
| 4,657,117 | 4/1987 | Lauer | 187/114 |
| 4,896,747 | 1/1990 | Inglis | 187/413 |
| 4,923,053 | 5/1990 | Daniels | 187/413 |
| 5,058,710 | 10/1991 | Iwasa | 187/290 |
| 5,162,623 | 11/1992 | Tachino | 187/290 |
| 5,433,293 | 7/1995 | Sager | 187/249 |

FOREIGN PATENT DOCUMENTS 1442212 7/1976 United Kingdom .

*Primary Examiner*—William E. Terrell
*Assistant Examiner*—Khoi H. Tran

[57] ABSTRACT

A socket plug assembly (44) on an elevator cab (10) may engage with complimentary socket plug assemblies (46) on either of two car frames (11, 13) when it is horizontally moved therebetween. A socket plug assembly (**44*a*) on a horizontally moveable elevator cab may have a horizontal interface with a complimentary socket plug assembly (45*b*) mounted on an elevator car frame or landing, and one of them is moved vertically to cause engagement with the other. Socket plug assemblies (169) tethered to a cab (10) by means of an umbilical cord (168) is engageable with socket plug assemblies (170, 171) on booms (172, 173) on the elevator car frames (21, 22) or landings. An uninterruptible power supply (50) maintains power when the cab is unplugged; a transceiver (51) on the cab maintains communications with a transceiver (62**) in the building when the cab is unplugged.

17 Claims, 5 Drawing Sheets

FIG.6
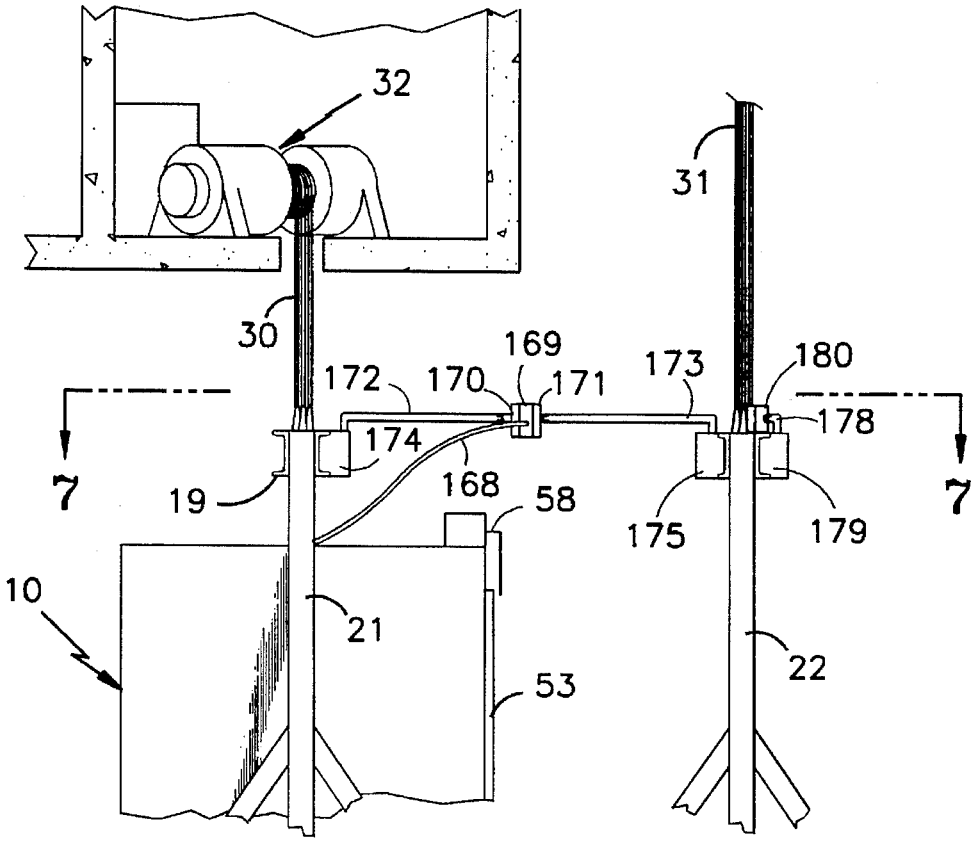
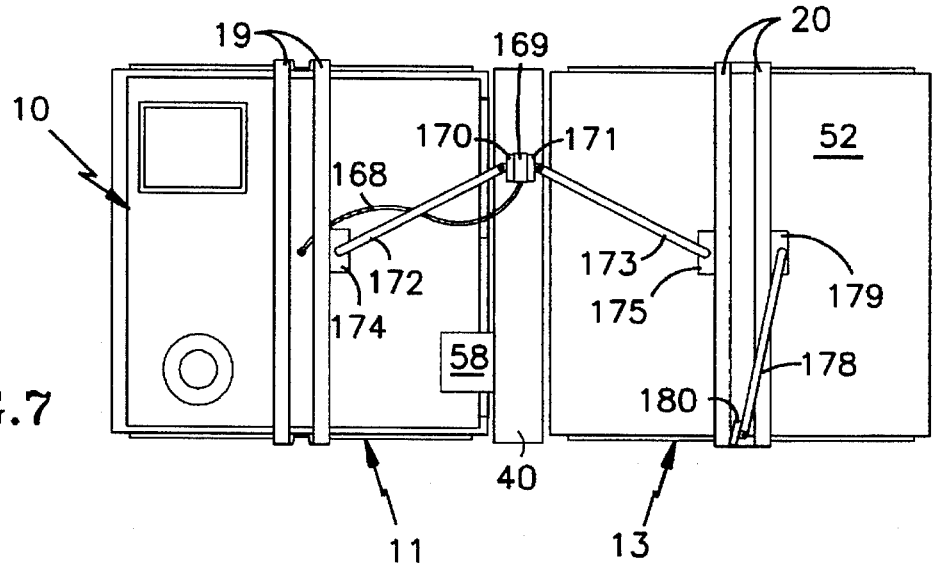
FIG.7

MAINTAINING COMMUNICATIONS AND POWER DURING TRANSFER OF HORIZONTALLY MOVEABLE ELEVATOR CAB

This is a continuation-in-part of application Ser. No. 08/565,647, filed Nov. 29, 1995, now abandoned.

TECHNICAL FIELD

This invention relates to maintaining power to and communications with a horizontally moveable elevator cab whenever the cab is not fully on an elevator car frame.

BACKGROUND ART

The sheer weight of the rope in the hoisting system of a conventional elevator limits their practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple cabs moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMs are not yet practical, principally because, without a counterweight, motor components and power consumption are prohibitively large.

In order to reach longer distances, an elevator cab may be moved in a first car frame in a first hoistway, from the ground floor up to a transfer floor, moved horizontally into a second elevator car frame in a second hoistway, and moved therein upwardly in the building, and so forth, as disclosed in a commonly owned, copending U.S. patent application Ser. No. 08/564,754, filed contemporaneously herewith. Since the loading and unloading of passengers takes considerable time, in contrast with high speed express runs of elevators, another way to increase hoistway utilization, thereby decreasing core requirements, includes moving the elevator cab out of the hoistway for unloading and loading, as is described in a commonly owned, copending U.S. patent application Ser. No. 08/565,606, filed contemporaneously herewith.

As a cab moves from one car frame to another, or between a car frame and a landing, it is necessary to maintain power for lighting and possibly for operating the doors. It is also necessary to maintain communications with the emergency phone, and with signals indicative of the status of the doors as well as position sensors utilized in the logistics of moving the cab.

DISCLOSURE OF THE INVENTION

Objects of the invention include maintaining power and communications with an elevator cab which is horizontally moveable between elevator car frames and landings, whenever the cab is not fully in place on a car frame and/or a landing; and transferring the power and communication connections from one elevator car frame to another elevator car frame, or to a landing, as an elevator cab is moved between car frames and landings.

According to the present invention, a socket/plug assembly in a horizontally moveable elevator cab is selectively engageable with socket/plug assemblies on elevator car frames and/or landings. According further to the invention, the interface of the socket/plug assemblies may be vertical, utilizing horizontal motion of the cab to engage them. According to the invention further, the interface between the socket/plug assemblies may be horizontal, employing a selectively operable means to move one of the socket plug assemblies vertically so as to engage the other. In still further accord with the invention, the socket plug assemblies may be moveable between car frames and landings on booms.

According to the invention, power is maintained on a horizontally moveable elevator cab by means of an energy storage device, such as a flywheel, a battery or an uninterruptible power supply, which is put in use when the cab is disengaged from any car frame or landing. In still further accord with the invention, a transceiver on a horizontally moveable elevator cab maintains communications with a transceiver in the building.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 6 is a simplified, fragmentary side elevation view of a portion of two elevator car frames illustrating an embodiment of the invention which uses booms.

FIG. 7 is a simplified top plan view taken on the line 7—7 in FIG. 6.

BEST MODE FOR CARRYING OUT THE INVENTION

Figure 1:
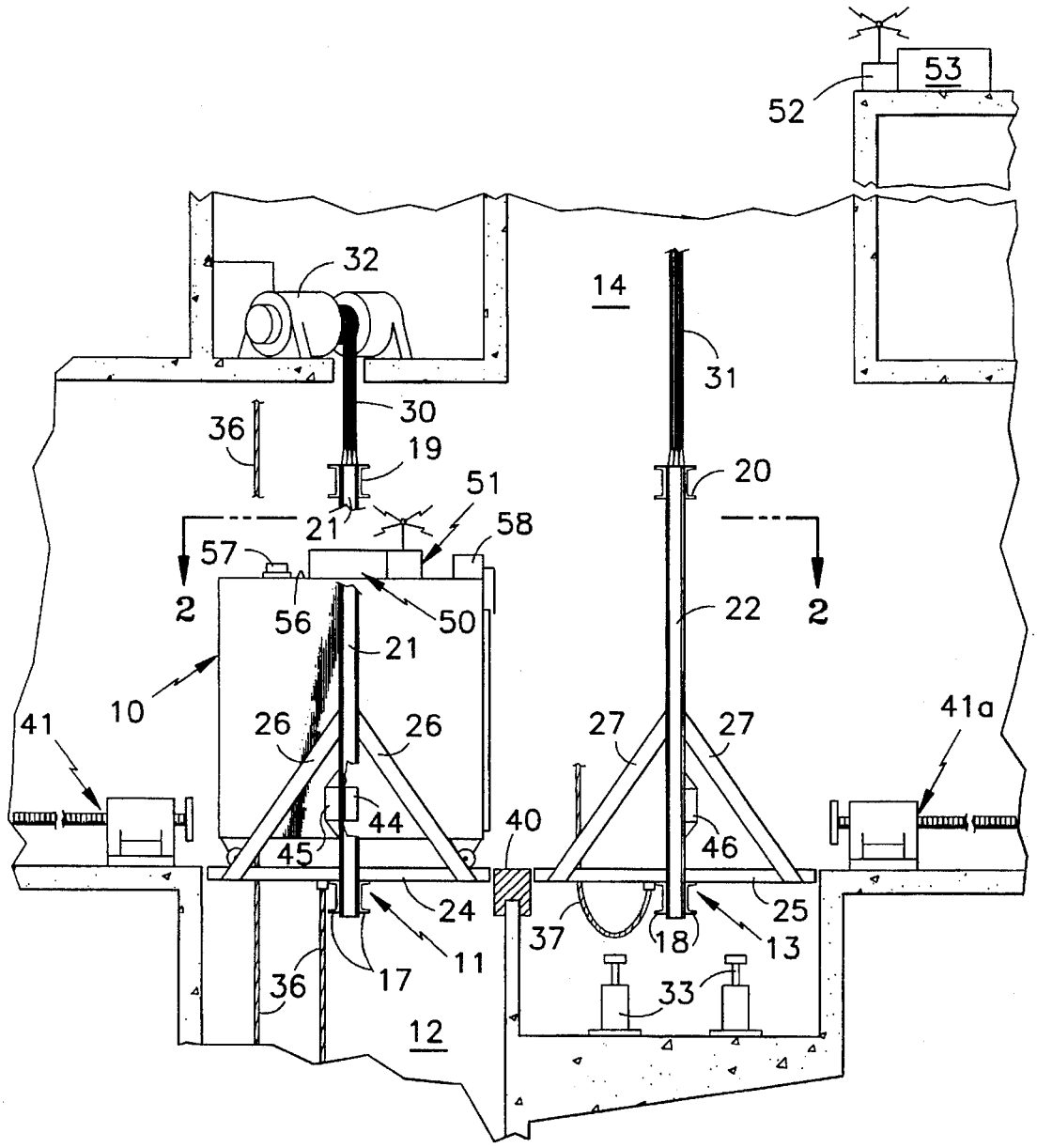
FIG. 1 is a simplified, partial, partially sectioned side elevation view of a transfer level where an elevator car employing the present invention is transferred from one hoistway to another.

Referring now to FIG. 1, an elevator cab 10 may be transferred horizontally from an elevator car frame 11 in a first hoistway 12 to a second elevator car frame 13 in a second hoistway 14. The elevator car frames 11, 13 each comprise a plank 17, 18, a crosshead 19, 20 and a pair of stiles 21, 22 (only one of which is shown in FIG. 1) extending therebetween. The planks 17, 18 may each support a platform 24, 25 supported by braces 26, 27. Each of the car frames has a hoisting system including ropes 30, 31, a hoist motor/brake assembly 32, counterweights, not shown, and hoistway buffers 33, all in the usual fashion. Each of the car frames 11, 13 is in communication with and receives power from the building by means of its traveling cable 36, 37. Except for the fact that the cab 10 is moveable from one car frame to the other, the description thus far is of typical elevator components.

In order to transfer the cab 10 between the car frames 11, 13 across a sill 40, a pair of horizontal motive means, 41 may push the car from side to side, in a fashion fully described in a commonly owned co-pending U.S. patent application, Ser. No. 08/564,704, filed contemporaneously herewith; or, the horizontal motive means 40, 41 may preferably take a more sophisticated form disclosed in a commonly owned U.S. patent application Ser. No. 08/564,704, filed contemporaneously herewith.

In accordance with the present invention, electrical power and communication signals, particularly power for the lights, door status signals for safety purposes, and the emergency bell and telephone, are maintained between the cab 10 and each car frame 11, 13 by virtue of a socket/plug assembly 44 disposed on the elevator car which will mate with either of two complementary socket/plug assemblies 45, 46 disposed on the car frames 11, 13 respectively. In the embodiment of FIG. 1, the socket/plug assemblies 45, 46 are affixed by brackets to a corresponding stile 21, 22. The socket/plug assemblies 44–46 may each comprise a plurality of male connectors on circuits receiving signals or voltage at a particular socket/plug assembly, and plurality of female connectors on circuits sending signals or providing voltage at a particular socket/plug assembly.

As the cab moves from the car frame 11 to the car frame 13, the socket/plug assembly 44 will become disconnected from the socket/plug assembly 45, and will eventually reconnect with the socket/plug assembly 46. In that fashion, power for and communication with the cab 10 are provided through the traveling cable 36, 37 and the car frame 11, 13 whenever the cab is disposed on one of the car frames 11, 13 by means of the socket/plug assemblies 44–46. However, as soon as the car begins to move, it is disconnected from either of the socket/plug assemblies 45, 46.

To accommodate the cab while in transit, the present invention provides temporary power from an energy storage device such as a battery, a flywheel or an uninterruptible power source 50 (UPS) and communications via a transceiver 51 which coacts with a similar transceiver 52 disposed in the building where it can communicate with all of the hoistways in which the cab (and/or additional cabs) are operating. The transceiver 52 may be disposed in proximity with a car/group controller 53. In this embodiment, the UPS 50 and transceiver 51 are disposed on a canopy 56 along with a fan 57, a door operator 58 and an emergency exit 59. The UPS 50 may be of a readily available type including a battery, a battery charger for maintaining the battery at full charge, an inverter for converting the battery voltage to AC voltage, a line voltage sensor and a transfer switch to switch the output from the line to the inverter whenever the input line voltage ceases. Thus, merely disconnecting one of the plug/socket units 45, 46 from the plug/socket unit 44 will automatically cause a switchover by the UPS. A DC flywheel motor generator, accelerated through a rectifier by AC power from the traveling cable, may provide suitable DC power to the cab (note that door power is not needed when transferring a cab between hoistways), such as through a DC/DC voltage regulator. The switchover is also used to enable the circuitry controlling the transceivers 51, 52, which typically include multiplexing/demultiplexing circuitry of the type normally used in hard-wired elevator systems. The transceiver may be used all of the time, or used only at times associated with disconnection of the cab from the car frame.

Figure 2:
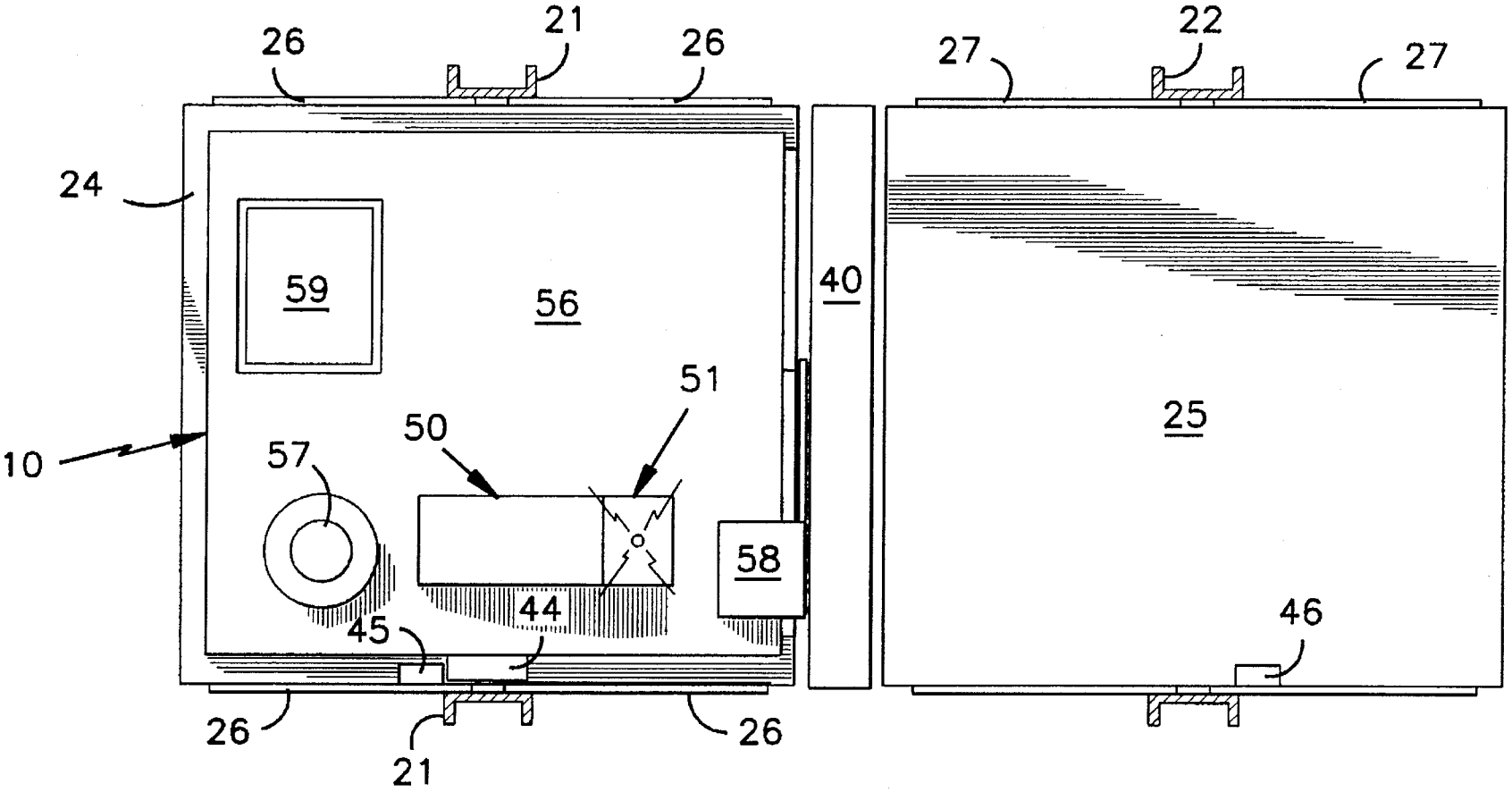
FIG. 2 is a simplified, top plan view taken on the line 2—2 in FIG. 1.

The embodiment illustrated in FIGS. 1 and 2, utilizing the plug/socket assemblies 44–46, is limited to use where a cab will enter a car frame from one side, and leave that car frame from the same side. In the aforementioned application Ser. No. 08/564,704 and in a commonly owned U.S. patent application Ser. No. 08/564,534, filed contemporaneously herewith, there are systems in which a cab will enter a car frame from one side and pass on through, leaving the car frame from the other side. In such a case, the plug/socket assemblies 45, 46 will block such passage. An embodiment of the invention useful in such cases is illustrated in FIGS. 3 and 4.

Figure 3:
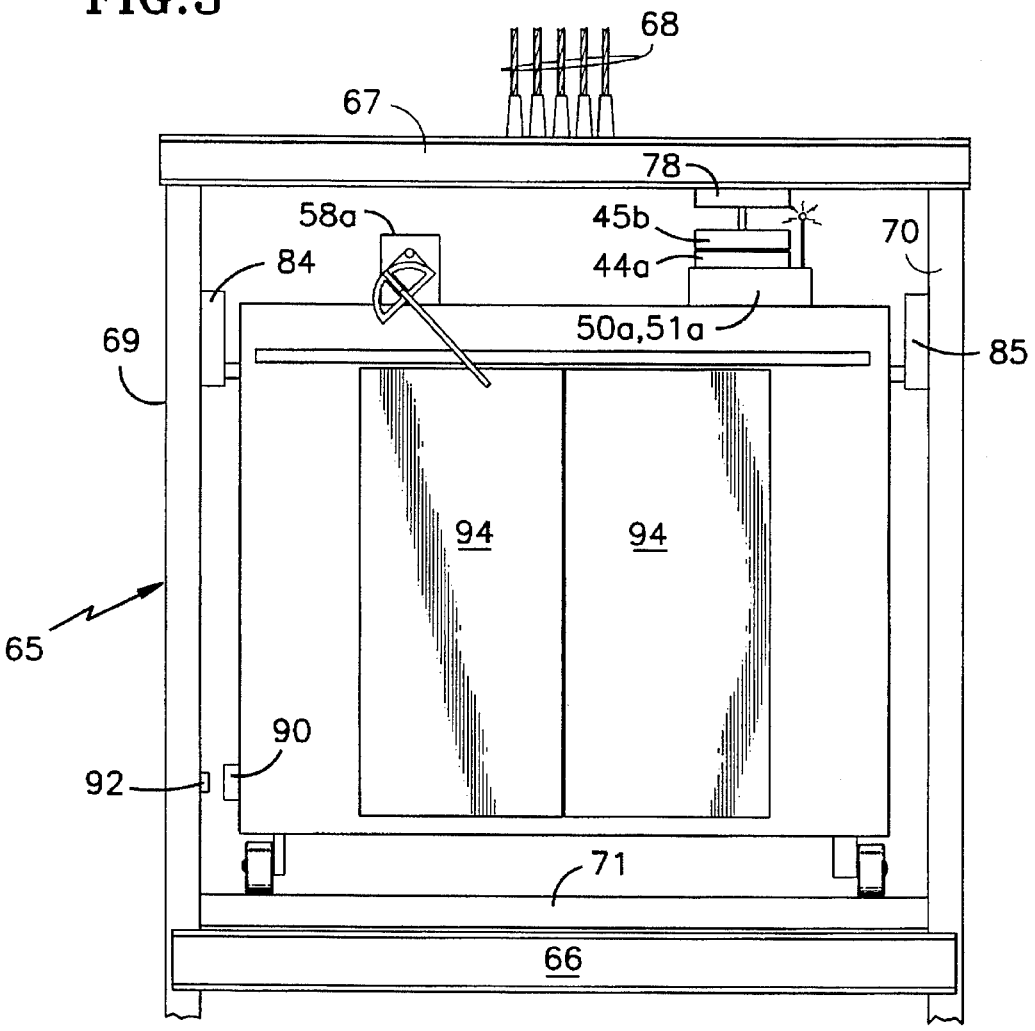
FIG. 3 is a simplified, partial front elevation view of an elevator employing a second embodiment of the invention.
Figure 4:
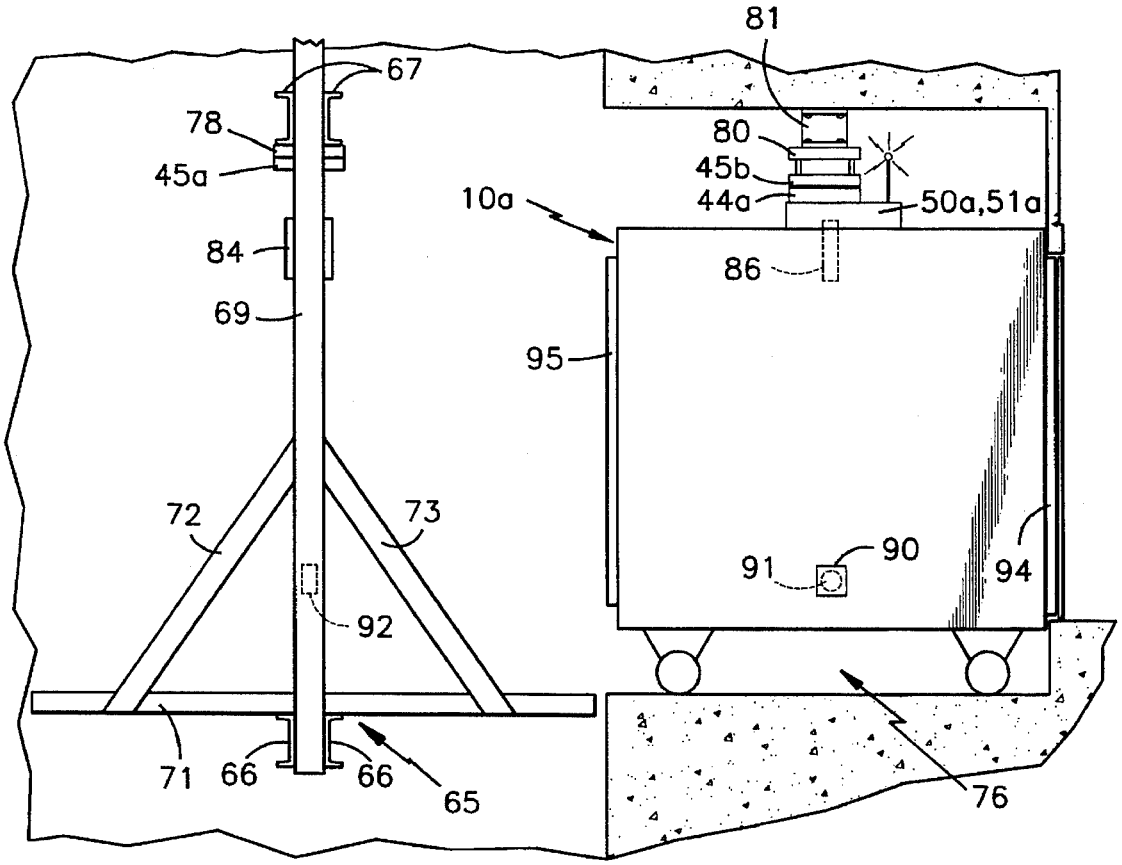
FIG. 4 is a partial, simplified side elevation view of the elevator cab of FIG. 3 in a landing.

Referring to FIGS. 3 and 4, an elevator car frame 65 includes a plank 66, a crosshead 67 that supports roping 68, a stile 69, 70 on each side of the frame, and a platform 71. As seen in FIG. 4, the cab frame 65 may have braces 72, 73 between the platform 71 and the stiles 69, 70. The braces 72, 73 are omitted from FIG. 3 for simplicity.

In FIG. 4, the cab is shown standing at a landing 76, having been moved horizontally to the right, off of the car frame 65. The horizontal motive means (similar to 40, 41 in FIG. 1) have not been shown in FIG. 4 for simplicity. However, the motive means described in the aforementioned application Ser. No. 08/564,704 may be used for transferring the cab between a car frame and a landing, as well as between one car frame and another, in both directions of travel.

In the embodiment of FIGS. 3 and 4, a socket/plug assembly **44*a* is disposed on the top of the cab 10*a*, such as on top of an assembly containing the UPS 50*a* and transceiver 51*a*. The car frame 65 has a complementary socket/plug assembly 45*a* and a landing 76 has a complementary socket/plug assembly 45*b*, each of which is extended upwardly when the cab is to be moved or is absent and downwardly when the cab is present, by corresponding plunger assemblies 78, 80 which may be disposed on the crosshead 67 and on a bracket 81 fixed to a surface of the landing 76, respectively. The plunger assemblies 78, 80** may be solenoid operated, or of any other suitable type that can force engagement and disengagement between the socket/plug assemblies in a rapid and reliable fashion.

In the embodiment of FIGS. 3 and 4, the alignment of the socket/plug assemblies is enhanced by means of cab locks 84–86 which may comprise a tapered lock bolt that slides into the bore of a strike thereby rigidly fixing the position of the cab to either the car frame or the landing, in a manner described in a commonly owned U.S. patent application Ser. No. 08/565,658, filed contemporaneously herewith. In such a case, sensing that the lock is engaged may be utilized to cause a plunger 78, 80 to engage the socket/plug assembly **45*a*, 45*b*. Sensing that the cab lock is fully disengaged might be utilized to cause the plunger 78, 80 to disengage the socket/plug assembly 45*a*, 45*b*. On the other hand, the invention of FIGS. 3 and 4 may be utilized without the additional benefit of the cab locks 84–86. In such a case, a position sensor 90 disposed on the cab may work in conjunction with complementary portions 91, 92 disposed on the landing and on the car frame, respectively. The apparatus 90–92 may comprise a switch and corresponding cam, or may comprise proximity sensors, or the like. In such a case, sensing that the cab is positioned on the car frame or the landing by the apparatus 90–92 may be utilized to cause the plunger assembly 78, 80 to engage one of the socket/plug assemblies 45***a*, 45*b*. Disengaging the socket/plug assemblies may be in response to a car controller preparing to give a transfer command, to transfer the cab between the car frame and the landing, or between a pair of car frames, in a manner described in the aforementioned applications Ser. Nos. (Attorney Docket Nos. OT-2230 and OT-2296), for instance.

Figure 5:
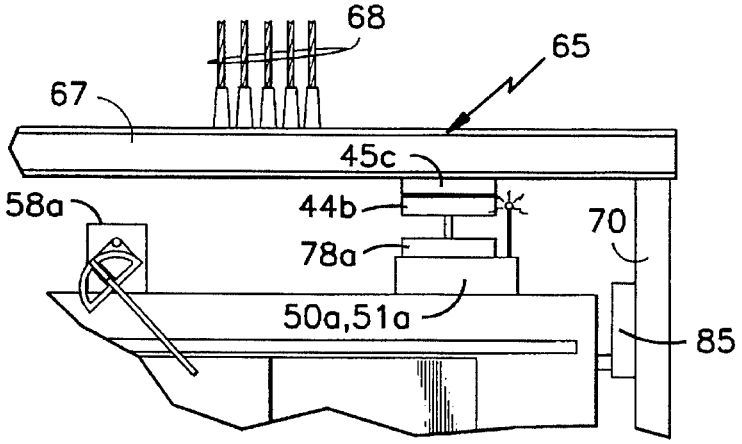
FIG. 5 is a simplified, fragmentary front elevation view of a portion of an elevator employing a third embodiment of the invention.

In the embodiment of FIGS. 3 and 4, the socket/plug assembly 44*a* is disposed rigidly to the cab, and the socket/plug assemblies 45*a* and 45*b* move to connect with it. In FIG. 5, a socket plug assembly 45*c* is disposed rigidly to the car frame 65, and a socket/plug assembly 44*b* is moveable up and down on the cab 65 by a plunger assembly 78*a*; any socket/plug assembly at a landing will also be rigid in this case.

In FIGS. 3 and 4, the cab 10*a* is shown having doors 94, 95 on both the front and the back, respectively. A door operator 58*a* is shown for the doors 94 in FIG. 3, the door operator for the doors 95 not being shown for clarity. In FIG. 4, both door operators are not shown, for clarity.

In an embodiment where the hoistways and landings are adjacent, the embodiment of FIGS. 6 and 7 may be used. Therein, power for lighting and circuits for the signals referred to hereinbefore are maintained by means of an umbilical cable 168 which has a two sided plug-socket assembly 169 connected at its distal end, the proximal end entering the cab 10 at its center (as shown in FIG. 7). The socket/plug 169 contains (on both a right side and left side as seen in FIGS. 2 and 3) a suitable number of pins and receptacles for the number of required circuits, which mate with corresponding socket/plug assemblies 170, 171 attached to respective booms 172, 173 which are controlled by boom rotating mechanisms or operators 174, 175 on the respective car frames 11, 13. The socket/plug assembly 169 is engaged with either one or the other of the socket/plug assemblies 170, 171, or both, at all times when the cab is on or between car frames 11 and 13. The frame 13 has a second boom 178 and boom operator 179 to use when the cab is transferring from the frame 13 to the car frame of a car or a landing to the right of car frame 13 (not shown). Each of the socket/plug assemblies 170, 171, 180 has a monostable solenoid plunger disposed therein which, in response to a release signal, will push the corresponding socket/plug assembly away from the socket/plug assembly 169 of the cab 10, so as to disengage therefrom, thereby permitting the booms 172, 173, 178 to be retracted when not in use. In order to effect transfer of cab communications and power from the boom 173 to the boom 178 after the cab is loaded onto frame 13, the retracted position (as shown by the boom 178) of the booms 173 and 178 are adjacent, whereby the socket/plug assembly 169 can be transferred from boom 172 to boom 173, then to boom 178 and then to a similar boom on a car frame to the right (not shown). In cases where the cab 10 may be transferred to landings, a boom will be arranged at each such landing.

The invention may be used in systems where the hoistways are not adjacent, and where a cab may move among many hoistways, such as in the aforementioned application Ser. No. 08/564,534. The transceivers may be used as the principal mode of communication, or as an auxiliary mode, used only when the cab is disconnected from a platform. The invention may be used for the entire time a cab is at a landing, in embodiments where landings are not provided with socket/plug assemblies.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system in a building, comprising:

a pair of elevators, each having a hoistway and an elevator car frame moveable between upper and lower ends of the corresponding hoistway, the upper end of one of said hoistways coinciding at a given level of said building with the lower end of the other one of said hoistways;

a cab which can be loaded onto the car frame of either of said elevators;

a first socket/plug assembly disposed on said cab and having a plurality of electrical contacts connected to circuits in said cab; and a plurality of second socket/plug assemblies, each having a plurality of electrical contacts complimentary to the contacts on said first socket/plug assembly, disposed on each of said car frames for engaging said first socket/plug assembly to connect circuits on said cab with circuits on one of said car frames when said cab is loaded onto said one car frame.

2. A system according to claim 1 wherein:

an interface between said first socket/plug assembly and one of said second socket/plug assemblies when they are engaged is vertical, and horizontal motion of cab on said car frames brings said socket/plug assemblies into and out of engagement.

3. A system according to claim 1 wherein:

an interface between said first socket/plug assembly and one of said second socket/plug assemblies when they are engaged is horizontal; and further comprising:

selectively operable means disposed with one of said socket/plug assemblies for imparting vertical motion thereto for bringing said socket/plug assemblies into and out of engagement with each other.

4. A system according to claim 3 wherein said selectively operable means is disposed on said cab.

5. A system according to claim 3, comprising:

a plurality of said selectively operable means, one disposed on each of said car frames.

6. A system according to claim 1, further comprising:

a landing in said building adjacent one of said hoistways for receiving said cab from the related one of said car frames; and one of said second socket/plug assemblies is disposed on said landing for engaging said first socket/plug assembly to connect circuits on said cab with circuits on said landing when said cab is loaded onto said landing.

7. A system according to claim 6 wherein:

said first socket plug assembly is connected to said cab by an umbilical cord; and said second socket plug assemblies are each disposed on a boom mounted on the corresponding one of said car frames and on the corresponding one of said landings, each boom rotatable to transfer said first socket/plug assembly from one of said booms to another of said booms.

8. A system according to claim 1, further comprising:

an energy storage system disposed on said cab and operable to supply power to said cab when said first socket/plug assembly is disengaged from all of said second socket plug assemblies.

9. A system according to claim 8, further comprising:

a first transceiver disposed on said cab; and a second transceiver disposed in said building for communicating with said first transceiver when said first transceiver is operated.

10. A system according to claim 1, further comprising:

a first transceiver disposed on said cab; and a second transceiver disposed in said building for communicating with said first transceiver when said first transceiver is operated.

11. A system according to claim 1 wherein:

said first socket/plug assembly is connected to said cab by an umbilical cord; and said second socket plug assemblies are each disposed on a boom mounted on the corresponding one of said car frames, each boom rotatable to transfer said first socket plug assembly from one of said booms to another of said booms.

12. An elevator system in a building, comprising:

a pair of elevators, each having a hoistway and an elevator car frame moveable between upper and lower ends of the corresponding hoistway, the upper end of one of said hoistways coinciding at a given level of said building with the lower end of the other one of said hoistways;

a cab which can be loaded onto the car frame of either of said elevators and transferrable therebetween, said cab having power and communication connections to either of said car frames when loaded thereon;

an energy storage system disposed on said cab and operable to supply power to said cab when said cab is disconnected from all of said car frames;

a first transceiver disposed on said cab; and a second transceiver disposed in said building for communicating with said first transceiver when said first transceiver is operated.

13. A system according to claim 8 wherein said energy storage system is an uninterruptible power supply.

14. A system according to claim 9 wherein said first transceiver is operated in response to said first socket/plug assembly being disengaged from all of said second socket/plug assemblies.

15. A system according to claim 10 wherein said first transceiver is operated in response to said first socket/plug assembly being disengaged from all of said second socket/plug assemblies.

16. A system according to claim 12 wherein said energy storage system is an uninterruptible power supply.

17. A system according to claim 12 wherein said first transceiver is operated only in response to the said cab being disconnected from all of said car frames.

* * * * *